US005352301A

United States Patent [19]

Panchanathan et al.

[11] Patent Number: 5,352,301

[45] Date of Patent: Oct. 4, 1994

[54] HOT PRESSED MAGNETS FORMED FROM ANISOTROPIC POWDERS

[75] Inventors: Viswanathan Panchanathan, Anderson; John J. Croat, Noblesville, both of Ind.

[73] Assignee: General Motors Corporation, Detroit, Mich.

[21] Appl. No.: 979,030

[22] Filed: Nov. 20, 1992

[51] Int. Cl.[5] ..... H01F 41/02

[52] U.S. Cl. ..... 148/101; 148/104; 419/12

[58] Field of Search ..... 148/101, 104; 419/12

[56] References Cited

U.S. PATENT DOCUMENTS

| | | | |
|---|---|---|---|
| 4,792,367 | 12/1988 | Lee | 148/104 |
| 4,802,931 | 2/1989 | Croat | 148/302 |
| 4,842,656 | 6/1989 | Maines et al. | 148/302 |
| 4,952,239 | 8/1990 | Tokunaga et al. | 148/302 |
| 4,983,232 | 1/1991 | Endoh et al. | 148/302 |
| 5,026,438 | 6/1991 | Young et al. | 148/101 |
| 5,143,560 | 9/1992 | Doser | 148/101 |
| 5,178,692 | 1/1993 | Panchanathan | 148/101 |

FOREIGN PATENT DOCUMENTS

92/13353 8/1992 PCT Int'l Appl. .

OTHER PUBLICATIONS

Heisz et al, "Isotropic and Anisotropic Nd-Fe-B-Type Magnets by Mechanical Alloying and Hot Pressing", *Applied Physics Letters*, vol. 53, No. 4, 25 Jul. 1988, pp. 342-343.

*Patent Abstracts of Japan*, vol. 13, No. 433, 27 Sep. 1989, Publication No. JP 1-161802.

*Primary Examiner*—George Wyszomierski

*Attorney, Agent, or Firm*—George A. Grove

[57] ABSTRACT

A method is provided for forming a high energy product, anisotropic, hot pressed iron-rare earth metal permanent magnet without the requirement for magnetic alignment during pressing or additional hot working steps. The method of this invention includes providing a quantity of anisotropic iron-rare earth metal particles and hot pressing the particles so as to form a substantially anisotropic permanent magnet. The pressed permanent magnet of this invention permits a greater variety of shapes as compared to conventional hot worked anisotropic permanent magnets. As a result, the magnetic properties and shape of the permanent magnet of this invention can be tailored to meet the particular needs of a given application.

14 Claims, 1 Drawing Sheet

HOT PRESSED MAGNETS FORMED FROM ANISOTROPIC POWDERS

The present invention generally relates to the making of high energy product permanent magnets based primarily on iron, neodymium and/or praseodymium, and boron. More specifically, this invention relates to the forming of such a magnet having an energy product of at least about 15 MGOe and higher by hot pressing magnetically anisotropic particles, wherein magnetic field alignment need not be present during the hot pressing step, and wherein the resultant anisotropic permanent magnet may be a variety of complex shapes which are not possible when hot working.

BACKGROUND OF THE INVENTION

Permanent magnets based on compositions containing iron, neodymium and/or praseodymium, and boron are known and in commercial usage. Such permanent magnets contain as an essential magnetic phase grains of tetragonal crystals in which the proportions of, for example, iron, neodymium and boron are exemplified by the empirical formula $Nd_2Fe_{14}B$. These magnet compositions and methods for making them are described by Croat in U.S. Pat. No. 4,802,931 issued Feb. 7, 1989. The grains of the magnetic phase are surrounded by a second phase that is typically rare earth-rich, as an example neodymium-rich, as compared with the essential magnetic phase. It is known that magnets based on such compositions may be prepared by rapidly solidifying, such as by melt spinning, a melt of the composition to produce fine grained, magnetically isotropic platelets of ribbon-like fragments. Magnets may be formed from these isotropic particles by practices which are known, such as bonding the particles together with a suitable resin.

Although the magnets formed from these isotropic ribbons are satisfactory for some applications, they typically exhibit an energy product (BHmax) of about 8 to about 10 megaGaussOersteds (MGOe), which is insufficient for many other applications. To improve the energy product, it is known to hot press the isotropic particles to form magnets having an energy product of about 13 to about 14 MGOe. Lee, U.S. Pat. No. 4,782,367, issued Dec. 20, 1988, went on to demonstrate that the melt-spun isotropic powder can be suitably hot pressed and hot worked by plastically deforming to create high strength, magnetically anisotropic permanent magnets. Being magnetically anisotropic, such magnets exhibit excellent magnetic properties, typically having an energy product of about 28 MGOe or higher. However, a shortcoming of the anisotropic magnets is that, because the final forming step is a plastic deformation process, the shapes in which the anisotropic magnets can be formed are significantly limited, particularly in comparison to the great variety of shapes which are possible with bonded and hot pressed isotropic magnets.

Another shortcoming with the production of anisotropic magnets is that the several processing steps required are time consuming, and the added hot working step increases the costs for making these magnets. In addition, the dies and punches required to hot work the magnets are generally complicated. As a result, anisotropic permanent magnets are typically more expensive to produce and, again, their shapes are limited by the equipment required to form them.

Magnets composed of bonded anisotropic particles having an energy product of about 15 to about 18 MGOe are known. The anisotropic particles are formed from hot-worked, anisotropic magnets, such as those described above, by known methods, such as mechanical grinding, pulverization and hydrogen decrepitation methods. The anisotropic particles are then bonded together with a suitable binder, such as a thermoset or thermoplastic, to form a permanent magnet. However, to achieve these high energy product values, it is necessary to subject the particles to an alignment field during processing. As a result, the possible shapes for the permanent magnet are again limited. In addition, processing is more difficult and complicated because the particles are already magnetized, which can be particularly detrimental in the computer industry where stray magnetic particles can seriously damage the operation of memory.

Therefore, although the above prior art permanent magnets are suitable for many applications, it would be desirable to provide a method for forming permanent magnets exhibiting an energy product of at least about 15 MGOe and above, and preferably about 20 MGOe or greater, in which the method has the advantage of being capable of forming permanent magnets having a great variety of shapes and yet does not require either a hot working step or magnetic alignment during hot pressing.

SUMMARY OF THE INVENTION

It is therefore an object of this invention to provide an anisotropic hot pressed permanent magnet exhibiting an energy product of at least about 15 MGOe, and preferably at least about 20 MGOe, without the requirement for magnetic alignment during hot pressing of the anisotropic particles.

It is another object of this invention that such a method be capable of forming substantially anisotropic permanent magnets having a greater variety of shapes than that possible with conventional hot-worked, anisotropic permanent magnets.

It is still another object of this invention that such an anisotropic hot pressed permanent magnet have a composition that has, as its magnetic constituent, the tetragonal crystal phase $RE_2TM_{14}B$ which is based primarily on neodymium and/or praseodymium, iron and boron.

It is a further object of this invention that such a permanent magnet contain magnetically anisotropic particles, with possible additions of magnetically isotropic particles, the relative quantities of each determining the magnetic properties of the permanent magnet.

It is yet a further object of this invention that such a permanent magnet be formed by hot pressing a quantity of magnetically anisotropic particles together to form a permanent magnet which is substantially anisotropic, or alternatively, by hot pressing a quantity of anisotropic and isotropic particles together to form a permanent magnet which is at least partially anisotropic.

In accordance with a preferred embodiment of this invention, these and other objects and advantages are accomplished as follows.

According to the present invention, there is provided a method for forming an anisotropic, hot pressed, iron-rare earth metal permanent magnet, wherein the permanent magnet exhibits an energy product of at least about 15 MGOe, and preferably at least about 20 MGOe. Yet, the energy products of this invention are achieved without magnetic field alignment during hot pressing of the anisotropic particles and without hot working of the anisotropic particles.

The method of this invention includes providing a quantity of anisotropic iron-rare earth metal particles, with possible additions of isotropic iron-rare earth metal particles, which are then hot pressed to form a substantially anisotropic high energy product permanent magnet. As an anisotropic hot pressed permanent magnet, a greater variety of shapes is possible than that for a hot worked, anisotropic permanent magnet. In addition, because the high energy products are obtained without the conventionally required magnetic alignment during pressing, a variety of complex shapes is again facilitated by this method. The magnetic properties and shape of the permanent magnet of this invention can be tailored to meet the particular needs of a given application.

Generally, the magnet composition of this invention comprises, on an atomic percentage basis, about 40 to 90 percent of iron or mixtures of cobalt and iron (TM), about 10 to 40 percent of rare earth metal (RE) that necessarily includes neodymium and/or praseodymium, and at least one-half percent boron. Preferably, iron makes up at least about 40 atomic percent of the total composition and neodymium and/or praseodymium make up at least about six atomic percent of the total composition. Also, preferably, the boron content is in the range of about 0.5 to about 10 atomic percent of the total composition, but the total boron content may suitably be higher than this depending on the intended application. It is further preferred that iron make up at least 60 atomic percent of the non-rare earth metal content, and that the neodymium and/or praseodymium make up at least about 60 atomic percent of the rare earth content. Although the specific examples of this invention are given in weight percents which fall within the above-described atomic percents, it is noted that the compositions of the various iron, rare-earth, boron and cobalt constituents may vary greatly within the preferred atomic ranges specified above.

Other metals may also be present in minor amounts up to about one weight percent, either alone or in combination. These metals include tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

The isotropic particles can be formed by known methods, such as melt spinning a suitable iron-rare earth metal composition to an overquenched or optimum condition. The preferred composition is, on a weight percent basis, about 26 to 32 percent rare earth, about 2 to about 16 percent cobalt, about 0.7 to about 1.1 percent boron, with the balance being essentially iron. Particles formed by this process are generally ribbon-shaped and can be readily reduced to particle size.

The anisotropic particles are preferably formed, in accordance with methods known in the prior art, by hot pressing and hot working isotropic particles having the above preferred composition so as to plastically deform the individual grains of the isotropic particles resulting in platelet-shaped anisotropic particles. The anisotropic hot worked body is then comminuted using known methods, such as mechanical grinding, pulverization or hydrogen decrepitation methods, so as to form a quantity of anisotropic particles. The hot worked shapes that can be used can be simple shapes, such as rectangular blocks, cylinders, etc., which are easily formed by hot working processes. The dimensional accuracy and surface finish are not very critical to this invention since they are later comminuted into particles. All that is needed is a high energy product, hot worked magnet without any shape or dimensional criticality.

In accordance with this invention, it has been determined that, by hot pressing a quantity of the plastically deformed, magnetically anisotropic particles, a permanent magnet is formed whose energy product is at least about 15 MGOe, and preferably at least about 20 MGOe, without the application of a magnetic field during pressing. Alternatively, hot pressing a mixture of isotropic and anisotropic particles produces a permanent magnet whose energy product is between about 15 and 21 MGOe, again without the need for applying a magnetic field during pressing.

In accordance with a first preferred embodiment of this invention, hot pressing a quantity of anisotropic particles alone produces a substantially anisotropic permanent magnet whose magnetic properties are superior to the bonded and hot pressed isotropic magnets of the prior art, as well as the bonded anisotropic magnets of the prior art, and more comparable to the magnetic properties of conventional anisotropic hot worked magnets. Yet, the variety of shapes in which the anisotropic permanent magnets of this invention may be made is far greater than the shapes possible with conventional hot worked anisotropic magnets in that, as a final processing step, hot working severely limits the variety of shapes in which a permanent magnet may be formed.

Accordingly, an advantageous feature of this invention is that energy products of at least about 15 MGOe, and preferably at least about 20 MGOe, may be easily achieved by this method, yet without the previous requirement for magnetic alignment during pressing or additional hot working.

Also, as stated previously, another significant advantage of this invention is that the anisotropic hot pressed permanent magnets of this invention have their final geometry determined by a hot pressing operation. As a result, the permanent magnets of this invention have a greater variety of shapes possible than the hot worked anisotropic magnets of the prior art, yet with somewhat comparable energy products obtained.

Other objects and advantages of this invention will be better appreciated from the following detailed description.

BRIEF DESCRIPTION OF THE DRAWINGS

Reference will be made to the accompanying drawing wherein.

DETAILED DESCRIPTION OF THE INVENTION

Figure 1:
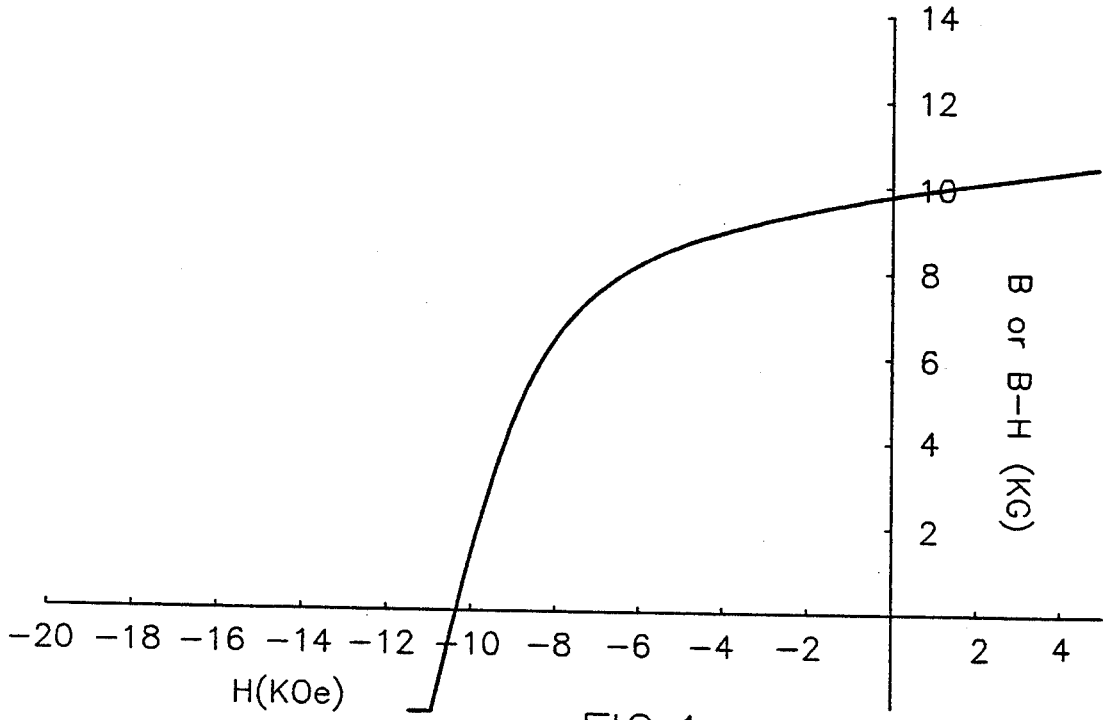
FIG. 1 illustrates the demagnetization curve for a hot pressed magnet formed from magnetically anisotropic particles, of the preferred iron-neodymium-boron composition, in accordance with a preferred embodiment of this invention.

The preferred method of the present invention forms an iron-rare earth metal high energy product, anisotropic, pressed permanent magnet which does not require the presence of magnetic alignment during pressing or the additional step of hot working the particles to achieve the high energy products. The preferred method includes hot pressing a quantity of anisotropic iron-rare earth metal particles, with possible additions of isotropic iron-rare earth metal particles, to form the high energy product anisotropic permanent magnet.

Appropriate compositions for the iron-rare earth metal permanent magnet of this invention include a suitable transition metal component, a suitable rare earth component and boron, as well as small additions of cobalt, and are generally represented by the empirical formula $RE_2TM_{14}B$. The preferred compositions, as stated previously, consist of, on an atomic percentage basis, about 40 to 90 percent of iron or mixtures of cobalt and iron, with the iron preferably making up at least 60 percent of the non-rare earth metal content; about 10 to 40 percent of rare earth metal that necessarily includes neodymium and/or praseodymium, with the neodymium and/or praseodymium preferably making up at least about 60 percent of the rare earth content; and at least one-half percent boron. Preferably, iron makes up at least about 40 atomic percent of the total composition and the neodymium and/or praseodymium make up at least about six atomic percent of the total composition. The boron content is preferably in the range of about 0.5 to about 10 atomic percent of the total composition, but the total boron content may suitably be higher than this depending on the intended application for the magnetic composition. Other metals may also be present in minor amounts up to about one weight percent, either alone or in combination, such as tungsten, chromium, nickel, aluminum, copper, magnesium, manganese, gallium, niobium, vanadium, molybdenum, titanium, tantalum, zirconium, carbon, tin and calcium. Silicon, oxygen and nitrogen will also usually be present in small amounts. The useful permanent magnet compositions suitable for practice with this invention are specified in U.S. Pat. No. 4,802,931 to Croat issued Feb. 7, 1989.

Specific compositions which have been useful in preparing hot worked, anisotropic permanent magnets of this type, in corresponding weight percentages, are as follows and contain the magnetic phase consisting of Fe14Nd2B (or the equivalent) tetragonal crystals; about 26 to 32 percent rare earth (wherein at least about 95% of this constituent is neodymium and the remainder is essentially praseodymium); about 0.7 to about 1.1 percent boron; and the balance being iron with cobalt being substituted for the iron in some instances from about 2 to about 16 percent.

However, it is to be understood that the teachings of this invention are applicable to the larger family of compositions as described previously in atomic percentages and will be referred to generally as an iron-neodymium-boron composition.

Generally, permanent magnetic bodies of this composition are formed by starting with alloy ingots which are melted by induction heating under a dry, substantially oxygen-free argon, inert or vacuum atmosphere to form a uniform molten composition. Preferably, the molten composition is then rapidly solidified to produce an amorphous material or a finely crystalline material in which the grain size is less than about 400 nanometers at its largest dimension. It is most preferred that the rapidly solidified material be amorphous or, if extremely finely crystalline, have a grain size smaller than about 20 nanometers. Such material may be produced, for example, by conventional melt-spinning operations. Conventionally, the substantially amorphous or microcrystalline, melt-spun iron-neodymium-boron ribbons are then milled to a powder, though the ribbons can be used directly according to this invention.

The iron-neodymium-boron particles, which are magnetically isotropic at this point, are then hot-pressed at a sufficient pressure and duration to form a fully dense material. Conventionally, this is achieved by heating the composition to a suitable temperature in a die and compacting the composition between upper and lower punches so as to form a substantially fully dense, flat cylindrical plug. Typically when melt-spun material finer than about 20 nanometers in grain size is heated at such an elevated temperature for a period of a minute or so and hot pressed to full density, the resultant body is a permanent magnet. Further, the magnetic body is slightly magnetically anisotropic (meaning that the magnetic body has a preferred direction of magnetization)- If the particulate material has been held at the hot pressing temperature for a suitable period of time, it will then have a grain size in the range of about 20 to about 500 nanometers, preferably abut 20 to 100 nanometers.

If the hot pressed body is then hot worked, that is, plastically deformed at such an elevated temperature so as to deform the grains, the resultant product displays appreciable magnetic anisotropy. The hot working step is typically carried out in a larger die, also at an elevated temperature, in which the hot pressed body is die upset to form a cylindrical plug. The resulting cylindrical plug is hard and strong, characterized by a density of typically about 7.5 grams per cubic centimeter, which is substantially full density.

If suitably practiced, the high temperature working produces a fine platelet microstructure, generally without affecting an increase in grain size above about 500 nanometers. Care is taken to cool the material before excessive grain growth and loss of coercivity occurs. The preferred direction of magnetization of the hot worked product is typically parallel to the direction of pressing and transverse to the direction of plastic flow. It is not uncommon for the hot worked product to have an energy product of about 28 MegaGaussOersteds or higher, depending on the upset ratio.

The hot worked, die upset body is unmagnetized, magnetically anisotropic, and has an appreciable magnetic coercivity. By die upsetting, the grains in the body are flattened and aligned with their major dimension lying transverse to the direction of pressing. The maximum dimensions of the grains are typically less than about 500 nanometers, and preferably in the range of about 100 to 300 nanometers. The grains contain tetragonal crystals in which the proportions of iron, neodymium and boron are in accordance with the formula Nd2Fe14B.

The actual temperatures employed to hot press and hot work the bodies can vary and will be discussed more fully in the specific examples below. Generally, the hot pressing and hot working are accomplished at the same elevated temperature, although this is not necessary.

While the above processing steps are generally conventional, at least two additional steps are required to form the hot pressed, substantially anisotropic permanent magnets in accordance with this invention. First, the hot worked, anisotropic body is reduced to particulate form using conventional comminution methods, such as by mechanical grinding, pulverization or hydrogen decrepitation methods, so as to form a quantity of magnetically anisotropic particles. This process does not change the grain size or shape of the particles which, as indicated before, are platelet-shaped and have lengths of less than about 500 nanometers, more preferably about 100 to about 300 nanometers. These particles are then hot pressed to form an anisotropic permanent magnet body which is characterized by an energy product of at least about 15 MGOe without the requirement of magnetic alignment during pressing and without the requirement for additional hot working of the particles.

The anisotropic particles may be hot pressed according to the same hot pressing steps described above for the isotropic particles. If desired, quantities of melt-spun isotropic particles may be mixed in with the anisotropic particles, so as to preferably tailor the resultant magnetic properties of the magnet body since the presence of the isotropic particles within the composition will slightly lower the magnetic properties of the hot pressed body. The isotropic particles can be obtained directly from the melt-spinning process or after the isotropic particles are annealed and/or pulverized into a powder.

The result is a substantially anisotropic, high energy product permanent magnet whose energy product is less than that of a hot worked, anisotropic magnet but substantially greater than that of a bonded or hot pressed isotropic magnet, yet which does not require the alignment by a magnetic field during pressing or additional hot working steps. Specifically, bonded isotropic magnets typically have an energy product in the range of about 8 to about 10 MGOe, while hot pressed isotropic magnets typically have an energy product in the range of about 10 to about 14 MGOe. In addition, bonded anisotropic magnets typically have an energy product of about 14 to about 18 MGOe. Permanent magnets according to this invention which are formed entirely from anisotropic particles are characterized by an energy product of at least about 20 MGOe and higher.

The magnetic properties of hot pressed, anisotropic permanent magnets formed in accordance with this invention were determined using conventional Hysteresis Graph Magnetometer (HGM) tests. Test samples were placed such that the axis parallel to the direction of alignment was parallel to the direction of the field applied by the HGM. The samples were each then magnetized to saturation and then demagnetized.

Figure 2:
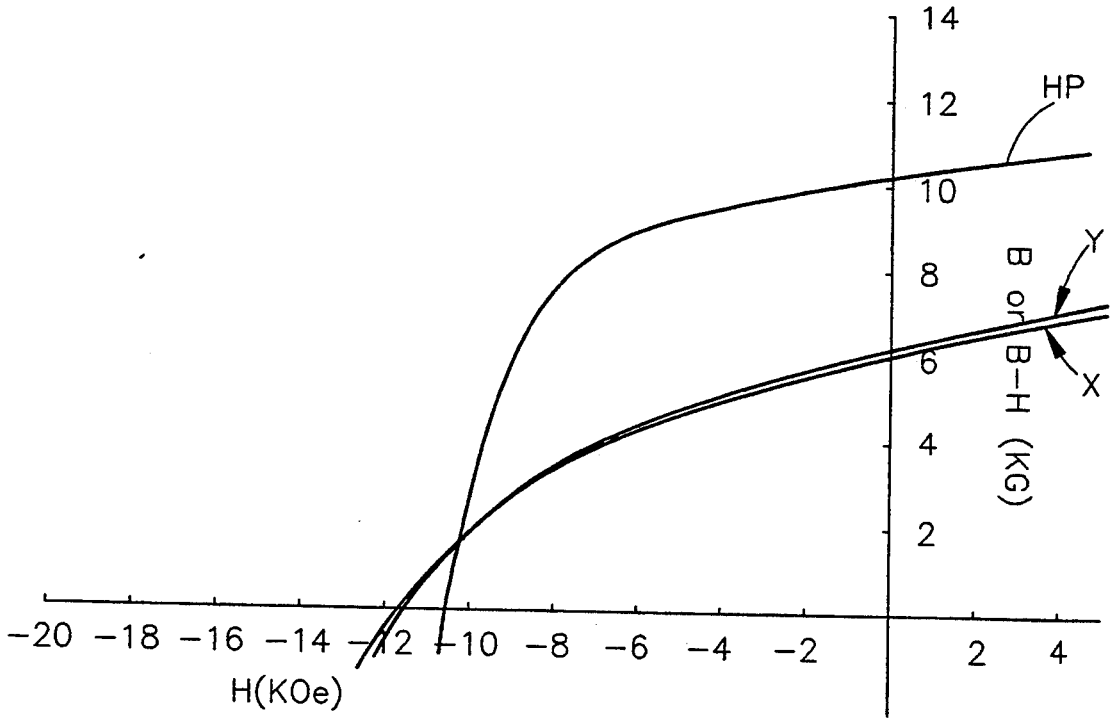
FIG. 2 illustrates demagnetization curves along each axis for a hot pressed magnet formed from the magnetically anisotropic particles of the preferred iron-neodymium-boron composition shown in FIG. 1.

The second quadrant demagnetization plots are shown in FIGS. 1 and 2 [$4\pi M$ in kiloGauss versus coercivity (H) in kiloOersteds] for the preferred anisotropic, hot pressed, permanent magnet of this invention. FIG. 1 illustrates the magnetic properties of an anisotropic permanent magnetic formed from only anisotropic particles, in accordance with a preferred embodiment of this invention. FIG. 2 illustrates the magnetic properties along each axis of the magnet of FIG. 1.

The specific samples tested are described more fully below.

Comparative Example 1

For comparative purposes, a conventional hot pressed isotropic permanent magnet was formed and tested. The nominal composition used to form this, as well as the other samples investigated, was, in weight percentage, about 30.5 percent rare earth (at least about 95% of this constituent being neodymium and the remainder being essentially praseodymium), about 1.0 percent boron, about 2.5 percent cobalt, and the balance being iron. Magnetically isotropic melt-spun ribbons of this composition were formed in an overquenched condition by use of the melt spinning process described above.

A hot pressed isotropic magnet was then formed. First, a preform was made from the ribbons, and then the preform was hot pressed at a temperature of about 750° C. to about 800° C., and under a pressure of about 5 to about 6 tons per square inch, to form magnets with a diameter of about 14 millimeters, a height of about 15.5 millimeters and a weight of about 18 grams.

Average values for magnetic properties obtained for these magnets were about 14.0 MGOe for an energy product (BHmax), about 8.0 kiloGauss (kG) for remanence (Br), and about 18.7 kiloOersteds (kOe) for intrinsic coercivity (Hci).

Example 2

A magnetic alloy having the same composition as the composition of Comparative Example 1 was used to form a second magnet. However, this magnetic composition was in the form of an anisotropic powder, in accordance with the teachings of this invention. The anisotropic particles were produced by hot pressing and then hot working a quantity of ribbons formed in accordance with Comparative Example 1. The hot pressing and hot working steps were conducted at a temperature of about 750° C. to about 800° C. The energy product of the hot worked anisotropic magnet was about 35 MGOe.

An anisotropic powder was then obtained by a conventional hydrogen decrepitation/desorption method. The hydrogen decrepitation step was carried out at about 450° C. using hydrogen at about ⅓ atmosphere (about 250 millitorr), while the desorption step was carried out at a temperature of about 650° C. A quantity of the anisotropic powder was then hot pressed at about 730° C. and at a pressure of about five tons per square inch so as to form a hot pressed, anisotropic permanent magnet having approximately the same dimensions of the hot pressed magnet of Comparative Example 1. Magnetic alignment was not required during the hot pressing steps in order to achieve the high energy products described below.

The demagnetization curves for this hot pressed anisotropic magnet are illustrated in FIG. 1. Average values for magnetic properties obtained for this magnet were an energy product of about 21.0 MGOe, a remanence of about 9.8 kG and an intrinsic coercivity of about 10.4 kOe.

As compared to the hot pressed isotropic magnet of Comparative Example 1, both the remanence and energy product are significantly improved, while the coercivity decreased. While maximum coercivity is important for some applications, for many others all that is required is a high remanence and energy product, so long as the coercivity is sufficient. One skilled in the art will recognize that the coercivity of the hot pressed anisotropic magnet of this example is sufficient for such purposes, particularly when coupled with the high energy products and remanences of this invention.

FIG. 2 shows the magnetic properties of a rectangular sample cut from a hot pressed anisotropic magnet prepared in accordance with Example 2 and shown in FIG. 1. The sample was about 9.4 by 9.4 by 7.6 millimeters. This sample was used to evaluate the magnetic properties in the direction in which the samples of Example 2 were pressed, as well as the two orthogonal axes transverse to the direction of pressing.

As would be expected, the magnetic properties in the direction of the pressing operation had magnetic properties essentially the same as is reported above for the hot pressed anisotropic magnets of Example 2, as previously indicated by the curve labeled "HP". Average values for magnetic properties in the transverse directions were about 7.0 MGOe for the energy product, about 6.1 kG for remanence, and about 11.6 kOe for intrinsic coercivity, as indicated by the curves labeled "X" and "Y".

From this data, the extent to which this sample was anisotropic was determined according to the anisotropy ratio formula:

$$Br/((Br)^2+(Br_x)^2+(Br_y)^2)^{0.5}$$

where Br is the remanence in the direction of pressing, $Br_x$ is the remanence in a first direction transverse to the direction of pressing, and $Br_y$ is the remanence in a second direction transverse to the direction of pressing and perpendicular to the first transverse direction. According to this formula, the anisotropy ratio for this sample was found to be 0.77, indicating the hot pressed anisotropic magnet was approximately 77 percent anisotropic.

Example 3

To determine whether the hot pressing temperature had any effect on the magnetic properties of permanent magnets formed in accordance with this invention, the magnetic alloy of the previous examples was used to form additional magnets. These magnets were formed from anisotropic powder in accordance with the process described in Example 2, with the exception that the final hot pressing step was conducted at temperatures of about 680° C., 750° C. or 790° C. The results of this investigation are provided in the table below.

| Hot Press Temp. (°C.) | Br (kG) | Hci (kOe) | BHmax (MGOe) |
|---|---|---|---|
| 680 | 10.2 | 10.3 | 23.0 |
| 750 | 10.2 | 10.4 | 23.0 |
| 790 | 10.2 | 10.1 | 23.0 |

From the above, it can be seen that the magnetic properties of the hot pressed anisotropic magnets of this invention remain substantially the same for hot pressing temperatures of between about 680° C. and 790° C. The properties are essentially the same for all temperatures. Thus, it would appear that the high energy products of this invention are due to the anisotropic magnetic properties of the particles and are not due primarily to the hot pressing parameters used to form the magnet, which is contrary to the conventional teachings with regard to hot pressed magnets formed from isotropic particles. Accordingly, there is an indication that a wide range of hot pressing temperatures exists which will produce the desired magnetic properties for the hot pressed anisotropic magnets of this invention, which in turn promotes the large-scale manufacturing of the magnets of this invention.

Example 4

To determine whether the magnetic properties of permanent magnets formed in accordance with this invention can be influenced by imposing a magnetic prealigning field prior to hot pressing, additional magnets were formed of the same composition as before. As in Example 3, these magnets were formed in accordance with the process described in Example 2, with the exception that nine grams of the anisotropic powder were used to form a cylindrical preform having a diameter of approximately 13.7 millimeters and a length of about 8 millimeters. The preform was made by initially aligning the anisotropic powder within a magnetic field with a magnetic field intensity of about 15 kOe. The aligned preform was then lubricated and hot pressed at a temperature of about 730° C. and a pressure of about 5 tons per square inch.

The remanence for this magnet was determined to be about 10.4 kG, as compared to a remanence of 10.2 kG for the hot pressed anisotropic magnets of Example 3, indicating that alignment does not significantly improve the magnetic properties of the hot pressed anisotropic magnets of this invention. Accordingly, it appears that the advantages of this invention can be substantially realized without the need for applying a magnetic field during processing of the anisotropic particles, which is again contrary to conventional teachings wherein magnetic field alignment substantially improves the energy products of bonded magnets from anisotropic particles.

Example 5

Again, a magnetic alloy having the same composition as in Comparative Example 1 was used to form additional magnets. These magnets contained additions of isotropic powder to the anisotropic powder to produce magnets which consisted of, by weight, approximately 75, 50 and 25 percent anisotropic particles, in accordance with this invention. As before, the anisotropic particles were produced by hot pressing and then hot working a quantity of ribbons formed in accordance with Comparative Example 1, and then comminuting into an anisotropic powder by hydrogen decrepitation.

The anisotropic powder was then mixed with melt-spun isotropic ribbons in accordance with the weight percentages noted above. The mixtures were then hot pressed at a temperature of about 730° C. and at a pressure of about 5 tons per square inch to form hot pressed permanent magnets with dimensions similar to that for Comparative Example 1.

Average values for the magnetic properties obtained for these hot pressed magnets are summarized below.

| % Anisotropic Powder | Br (kG) | Hci (kOe) | BHmax (MGOe) |
|---|---|---|---|
| 75 | 9.5 | 11.0 | 18.5 |
| 50 | 8.8 | 13.7 | 16.8 |
| 25 | 8.5 | 15.5 | 15.2 |

As with the samples of Example 2, the coercivities here were sufficient such that the high remanences and energy products of these samples would be suitable for many applications which require a permanent magnet.

From the above, it can be seen that hot pressed permanent magnets formed from anisotropic particles, with or without additions of isotropic particles, of a neodymium-iron-boron composition exhibit higher energy products than that of hot pressed isotropic permanent magnets formed in accordance with the prior art. The magnets in Examples 2 and 3 are formed with only anisotropic particles. The anisotropic particles in these examples were made from hot worked anisotropic magnets having energy products of about 35 MGOe, though hot worked anisotropic magnets have a potential for energy products of nearly about 50 MGOe. Accordingly, it is foreseeable that energy products of between about 25 and about 30 MGOe can be realized for hot pressed anisotropic particles made in accordance with the teachings of this invention. Again, such results would be expected to be relatively independent of the pressing temperature used.

While the preferred composition necessarily contains iron, neodymium and/or praseodymium, and boron, the presence of cobalt is optional. The composition may also contain other minor constituents, such as tungsten, chromium, nickel, aluminum, copper, magnesium, manganese, gallium, niobium, vanadium, molybdenum, titanium, tantalum, zirconium, carbon, tin, calcium, silicon, oxygen and nitrogen, providing that the isotropic and anisotropic particles contain the magnetic phase $RE_2TM_{14}B$ along with at least one additional phase at the grain boundaries that is richer in rare earth. In the essential magnetic phase, TM is preferably at least about 60 percent iron and RE is preferably at least about 60 percent neodymium and/or praseodymium.

A particularly advantageous feature of this invention is that high energy product, anisotropic hot pressed permanent magnets may be formed, without the requirement for magnetic alignment during hot pressing and also without the conventional hot working steps previously required to obtain these high energy products, both of which unduly complicate the processing of these types of magnets and limit the shape of the resultant magnet bodies. These are particularly advantageous features of this invention. The samples of Examples 2 and 3, which were formed in accordance with the preferred embodiment of this invention, illustrate that hot pressing a quantity of anisotropic particles alone produces a substantially anisotropic magnetic composition whose magnetic properties are superior to bonded and hot pressed isotropic magnets or bonded anisotropic magnets of the prior art.

The results of samples tested in Examples 3 and 4 indicate that the hot pressed anisotropic magnets of this invention can be formed within a relatively wide range of hot pressing temperatures and without the need for prealigning the anisotropic particles prior to hot pressing. This would appear to indicate that the plastically deformed platelet shape of the anisotropic particles provides the high energy product of the resultant magnet and does not deteriorate during the hot pressing operation. As a result, nearly optimal magnetic properties can be achieved with a relatively uncomplicated process which is amenable to large-scale manufacturing.

The samples of Example 5 illustrate that hot pressing a mixture of isotropic and anisotropic particles produces a magnetic composition whose magnetic properties are also superior to bonded and hot pressed isotropic magnets of the prior art.

Moreover, it is truly an advantageous feature of this invention that the permanent magnets have their final geometry determined by a hot pressing operation. As a result, the substantially anisotropic permanent magnets of this invention have a greater variety of shapes possible than the hot worked anisotropic magnets of the prior art. The variety of shapes in which hot pressed permanent magnets may be made is far greater than that possible with hot worked anisotropic magnets in that the hot working process limits the types of shapes which can be produced.

Therefore, while this invention has been described in terms of a preferred embodiment, it is apparent that other forms could be adopted by one skilled in the art. For example, the composition of the magnetic particles could be varied within the preferred weight and atomic ranges, with or without other constituents as described above, or different and/or additional processing steps may be employed to produce the isotropic and anisotropic particles. Accordingly, the scope of this invention is to be limited only by the following claims.

The embodiments of the invention in which an exclusive property or privilege is claimed are defined as follows:

1. A method for forming a hot pressed iron-rare earth metal permanent magnet, the method comprising the steps of:

providing platelet-shaped anisotropic iron-rare earth metal particles, wherein the anisotropic iron-rare earth metal particles are formed from a composition comprising, on an atomic percent basis, about 40 to about 90 percent iron or a mixture of cobalt and iron, about 10 to about 40 percent rare earth, and at least about 0.5 percent boron; and hot pressing a quantity of the anisotropic iron-rare earth metal particles in the absence of a magnetic alignment field such that the anisotropic iron-rare earth metal particles are substantially magnetically nonaligned during the hot pressing step, the hot pressing step forming the hot pressed anisotropic iron-rare earth metal permanent magnet, the hot pressed iron-rare earth metal permanent magnet having platelet-shaped grains and exhibiting a magnetic anisotropy and an energy product which is greater than that of a hot pressed isotropic magnet having a substantially similar composition, and which is less than that of a hot worked anisotropic magnet having a substantially similar composition;

wherein the hot pressed anisotropic iron-rare earth metal permanent magnet exhibits an energy product of at least about 15 megaGaussOersteds.

2. A method for forming a hot pressed iron-rare earth metal permanent magnet as recited in claim 1 wherein the anisotropic iron-rare earth metal particles are formed from a composition comprising, on a weight percent basis, about 26 to 32 percent rare earth, about 0.7 to about 1.1 percent boron, with the balance being essentially iron.

3. A method for forming a hot pressed iron-rare earth metal permanent magnet as recited in claim 2, wherein the composition further comprises about 2 to about 16 percent cobalt.

4. A method for forming a hot pressed iron-rare earth metal permanent magnet as recited in claim 1 wherein the anisotropic iron-rare earth metal particles have a grain size of not more than about 500 nanometers.

5. A method for forming a hot pressed iron-rare earth metal permanent magnet as recited in claim 1 wherein isotropic iron-rare earth metal particles are mixed with the anisotropic iron-rare earth metal particles prior to the hot pressing step so as to form a mixture.

6. A method for forming a hot pressed iron-rare earth metal permanent magnet as recited in claim 5 wherein the isotropic iron-rare earth metal particles are formed from a composition comprising, on a weight percent basis, about 26 to 32 percent rare earth, about 0.7 to about 1.1 percent boron, with the balance being essentially iron.

7. A method for forming a hot pressed iron-rare earth metal permanent magnet as recited in claim 6, wherein the composition further comprises about 2 to about 16 percent cobalt.

8. A method for forming a hot pressed iron-rare earth metal permanent magnet as recited in claim 1 wherein the anisotropic iron-rare earth metal particles are formed according to a method comprising the steps of:

providing a quantity of isotropic iron-rare earth metal particles;

hot pressing the quantity of isotropic iron-rare earth metal particles to form an isotropic magnet body;

hot working the isotropic magnetic body so as to plastically deform the grains of the isotropic iron-rare earth metal particles, so as to form an anisotropic magnet body; and comminuting the anisotropic magnet body so as to form the anisotropic iron-rare earth metal particles from the anisotropic magnetic body.

9. A method for forming a hot pressed iron-rare earth metal permanent magnet as recited in claim 8 wherein the comminuting step comprises a hydrogen decrepitation and desorption process.

10. A method for forming a hot pressed iron-rare earth metal permanent magnet comprising, on a weight percent basis, about 26 to 32 percent rare earth wherein at least about 90 percent of this constituent is neodymium, about 0.7 to about 1.1 percent boron, and the balance being essentially iron, the method comprising the steps of:

melt spinning a hot pressed iron-rare earth metal composition to form overquenched ribbons;

forming isotropic iron-rare earth particles from the ribbons;

hot pressing the isotropic iron-rare earth metal particles to form an isotropic magnet body;

hot working the isotropic magnetic body so as to plastically deform the iron-rare earth metal particles of the isotropic magnet body, so as to form an anisotropic magnet body;

comminuting the anisotropic magnet body so as to form platelet-shaped anisotropic iron-rare earth metal particles from the anisotropic magnet body; and hot pressing a quantity of the anisotropic iron-rare earth metal particles in the absence of a magnetic alignment field such that the anisotropic iron-rare earth metal particles are substantially magnetically nonaligned during the hot pressing step, the hot pressing step forming the hot pressed iron-rare earth metal permanent magnet;

whereby the iron-rare earth metal permanent magnet exhibits an energy product of at least about 15 megaGaussOersteds.

11. A method for forming a hot pressed iron-rare earth metal permanent magnet as recited in claim 10 wherein the comminuting step comprises a hydrogen decrepitation process.

12. A method for forming a hot pressed iron-rare earth metal permanent magnet as recited in claim 10 wherein the anisotropic iron-rare earth metal particles have a grain size of not more than about 500 nanometers.

13. A method for forming a hot pressed iron-rare earth metal permanent magnet as recited in claim 10 wherein the hot pressed iron-rare earth metal permanent magnet further comprises one or more additions chosen from the group consisting of tungsten, chromium, nickel, aluminum, copper, magnesium, manganese, gallium, niobium, vanadium, molybdenum, titanium, tantalum, zirconium, carbon, tin, calcium, silicon, oxygen and nitrogen.

14. A method for forming a hot pressed iron-rare earth metal permanent magnet as recited in claim 10, wherein said magnet further comprises about 2 to about 16 percent cobalt.

* * * * *